US012233506B2

(12) United States Patent
Bagdal

(10) Patent No.: US 12,233,506 B2
(45) Date of Patent: Feb. 25, 2025

(54) CENTERLESS ROLL GRINDING MACHINE WITH REDUCED RADIAL VARIATION ERRORS

(71) Applicant: Karl Bagdal, Middletown, OH (US)

(72) Inventor: Karl Bagdal, Middletown, OH (US)

( * ) Notice: Subject to any disclaimer, the term of this patent is extended or adjusted under 35 U.S.C. 154(b) by 764 days.

(21) Appl. No.: 17/370,536

(22) Filed: Jul. 8, 2021

(65) Prior Publication Data

US 2022/0016737 A1 Jan. 20, 2022

Related U.S. Application Data

(60) Provisional application No. 63/053,301, filed on Jul. 17, 2020.

(51) Int. Cl.
*B24B 5/22* (2006.01)
*B24B 5/307* (2006.01)

(52) U.S. Cl.
CPC ..... *B24B 5/22* (2013.01); *B24B 5/307* (2013.01)

(58) Field of Classification Search
CPC ..... B25B 1/2426; B25B 1/20; B25B 1/2452; B25B 1/241; B25B 5/22; B25B 5/307; B25B 5/04; B25B 5/18; B25B 5/167; B25B 5/37; Y10T 279/19
USPC ..... 451/49; 269/258; 279/110
See application file for complete search history.

(56) References Cited

U.S. PATENT DOCUMENTS 1,059,545 A * 4/1913 Rattazzini ..... B25B 5/163 269/258
4,766,703 A * 8/1988 Rattazzini ..... B23Q 1/76 451/24
5,402,606 A 4/1995 Helgren
5,830,044 A 11/1998 Rohde et al.
5,853,318 A 12/1998 Thom et al.
6,988,937 B2 1/2006 Bonner et al.
8,075,373 B2 12/2011 Wang
10,933,424 B1 3/2021 Zebroski et al.
2003/0194954 A1 10/2003 Bonner et al.
2009/0209183 A1 8/2009 Wang
2011/0045739 A1 2/2011 Keijzer et al.
2014/0326811 A1 11/2014 Daniels et al.
(Continued)

FOREIGN PATENT DOCUMENTS

EP 241070 A * 10/1987 ..... B23Q 1/76

OTHER PUBLICATIONS

EP-241070-A translation (Year: 1987).*

*Primary Examiner* — Robert F Neibaur
(74) *Attorney, Agent, or Firm* — Jenei LLC

(57) ABSTRACT

A centerless roll grinding machine includes a lateral support of a V-channel support that is received by a vertical support of a frame and extending horizontally in the first direction to contact a second side of one neck of a work roll. A lower support received by and extending generally upwardly from the frame displaced in the first lateral direction from a geometric center of the neck of the work roll cooperates with the lateral support to provide the V-channel support to hold the work roll for rotation about a longitudinal axis. A lateral support device includes radially spaced bearing pads on the neck in opposition to a grinding wheel. Each pair of bearing pads is pivotally attached to a respective first tier averaging link that is pivotally coupled to a horizontal ram to reduce displacements of the work roll caused by errors in the neck.

3 Claims, 9 Drawing Sheets

(56) References Cited

U.S. PATENT DOCUMENTS

| | | | |
|---|---|---|---|
| 2019/0015944 | A1 | 1/2019 | Spruit |
| 2021/0178401 | A1 | 6/2021 | Zebroski et al. |

* cited by examiner

CENTERLESS ROLL GRINDING MACHINE WITH REDUCED RADIAL VARIATION ERRORS

CROSS-REFERENCE TO RELATED APPLICATIONS

This application claims the benefit of priority under 35 U.S.C. § 119(e) to U.S. Patent Application Provisional Application Ser. No. 63/053,301, entitled "CENTERLESS ROLL GRINDING MACHINE WITH REDUCED RADIAL VARIATION ERRORS," filed Jul. 17, 2020, the contents of which are hereby incorporated by reference in their entirety for any purpose.

BACKGROUND

1. Technical Field

The present disclosure relates to an apparatus and process for machining of back-up and work rolls such as utilized in steel rolling processes, and more specifically to workpiece holders of centerless roll grinding machines for machining of back-up and work rolls.

2. Description of the Related Art

A heated slab as thick as several hundreds of millimeters, which is produced by continuous casting, etc., is rolled to a steel strip as thick as several to several tens of millimeters by a hot strip mill comprising a roughing mill and a finishing mill. The finishing mill usually comprises 5 to 7 four-high stands arranged in tandem. In the case of a seven-stand finishing mill, first to third stands are called "front stands," and fourth to seventh stands are called "rear stands."

The pressure and heat in a mill stand are so high that the rolls flex slightly. This would cause the steel sheet to be slightly thicker at the center than the edges. To compensate, the rolls are formed to be slightly fatter at the center than the edges. This is called a "crown" profile. A crown might be as small as a few thousands (0.001) of an inch. Other profiles are used. In modern mills, roll profiles can be very complicated.

Of course, the surfaces of the rolls must not have surface irregularities that produce undesirable surface quality of the steel strip. Imperfections in the roll surface will cause imperfections in the surface of the rolled sheet. An uneven shape of the roll causes unevenness in the rolled product, which at the very least means a waste of rolled material. Over a period of use, rolls undergo wear and deterioration in surface quality. From time to time the rolls need to be reshaped by machining or grinding.

In steel rolling, metal forming, and similar processes, gage variations which are induced in flat rolled sheet products by eccentricity of the back-up and/or work rolls, is a widespread problem which is growing in criticality as a result of increasing demand for improved control of gage variation and strip shape. Eccentricity is defined as the sum of out-of-roundness and concentricity errors. The gage thickness variation of the final formed sheet is directly dependent upon the radial variation of the rolls and the roll's concentricity errors. Minimizing thickness variation in the sheet products is critical to enabling the most efficient use of materials and energy to produce acceptable products.

Rolls are shaped and reshaped by a process known as "roll grinding." Modern off-line roll grinders comprise a headstock that journals the roll and rotates the roll about its axis.

A carriage moves parallel to the roll axis supporting a grinding wheel that rotates at several hundred RPM. A stream of water cools the grinding wheel and roll. The grinding wheel axis is held by an infeed mechanism that precisely moves the grinding wheel toward the roll.

Modern roll grinders are computer controlled. Grinding involves a number of steps from coarse fast grinding to slow finish grinding. This includes carefully bringing the grinding wheel to the roll and periodic measurement. The measurements are often continuous made by a high-precision computer controlled electronic caliper mounted on the roll grinder. It is desirable for the grinding operation to return the roll, within tolerance, to the desired profile and surface condition within the minimum time, removing the minimum amount of material from the surface of the roll.

FIG. 1 is a front view and FIG. 2 is a side view of a generally known four-high steel rolling machine 100. FIG. 2 is a side view of the generally-known four-high steel rolling machine 100 of FIG. 1 having work rolls 102*a*-102*b* and backup rolls 104*a*-104*b* that press a steel product 106 from an upstream thicker product 106' (FIG. 2). For clarity, chocks are omitted in FIGS. 1-2 that rotatably receive each cylindrical neck 108 of the work rolls 102*a*-102*b* and backup rolls 104*a*-104*b*. The steel product 106 passes between the top work roll 102*a* and the bottom work roll 102*b*. The top backup roll 104*a* is above and in rolling contact with the top work roll 102*a*. The bottom backup roller 104*b* is below and in rolling contact with the bottom work roll 102*b*. With particular reference to FIG. 1, each backup roll 104*a*-104*b* includes a conical neck 110 that transitions to the diameter of each end of the backup roll 104*a*-104*b* from a wider diameter central cylinder 112 of about 58 inches to the respective cylindrical neck 108. Work To provide vertical compression to the steel product 106 of up 3000 tons, two chocks 111*a*-111*b* that are actuated respectively by hydraulic cylinders 115 respectively press downward on the two conical necks 110 of the top backup roll 104*a* and two load cells 113*a*-113*b* respectively react to the two conical necks 110 of the bottom backup roll 104*b*. Compressive load paths 114*a*-114*b* pass between hydraulically-actuated chock 111*a* and load cell 113*a* and between chock 111*b* and load cell 113*b*. Force variation can occur in ten (10) transition points for each compressive load path 114*a*-114*b* including: (i) variations respectively between a top chock 111*a*-111*b* and a conical neck 110 of the top backup roller 104*a*; (ii) a concentricity error difference 114 between an axis of rotation 116 of a conical neck 110 of the top backup roller 104*a* and an axial centerline 118 in a center of rotation of top backup roll 104*a*; (iii) an outer surface of the wider diameter central cylinder 112 of the top backup roll 104*a*; (iv) variations in an outer diameter of a wider diameter central cylinder 120 of the top work roll 102*a*; (v) variations in radius of top work roll 102*a* that is contact with upper surface of strip being rolled; (v) variations in an outer diameter of a wider diameter central cylinder 120 of the bottom work roll 102*b*; (vii) an outer surface of the wider diameter central cylinder 112 of the bottom backup roll 104*b*; (ix) a concentricity error difference 122 between an axis of rotation 116 of a conical neck 110 of the lower backup roller 112 and an axial centerline 124 in a center of rotation of bottom backup roll 104*b*; and (x) variation between load cells 113*a*-113*b* and a corresponding conical neck 110 of the bottom backup roll 104*b*. The load cells 113*a*-113*b* are supported by a stand or side frame 117.

FIG. 3 depicts a generally known centerless roll grinding machine 300 having lateral ram 302 and lower ram 304 of a V-block 305 that contact a cylindrical neck 306 of a work roll 308. Roll 308 can be one of a work roll 102*a*-102*b* or backup roll 104*a*-104*b* (FIG. 1). A grinding wheel 310 on work side of the work roll 308 opposite to the lateral supports 302 is used to remove a worn body of a wider central portion 312 of the work roll 308. The lateral force exerted by grinding wheel 310 typically results in a greater force at the lateral supports 302 than the lower supports 302. The fixed lateral and lower supports 302, 304 are solid columns, causing movement of an axial centerline 314 of the wider central portion 312 of the work roll 308 when an eccentricity of the neck 306 of the work roll 308 is encountered. Although generally circular in cross section, most necks 306 of a work roll 308 have radii that vary in a range of about 0.0002 inch to 0.0006 inch when new. The radial variation becomes progressively worse with early life in rolling until removed from service for grinding. The grinding wheel 310 copies those variations in the neck 306 into the machined surface of the wider central portion 312 of the work roll 308. In particular, since the generally grinding machine 300 finishes grinding a work roll 308 by no longer moving horizontally inwardly (to the left as depicted), the grinding wheel 308 will create varying radii in the wider central portion 312 that correspond directly to the varying radii of the neck 306. Rather than being a roundness generating machine, the generally known grinding machine 300 is a shape reproducing machine.

BRIEF SUMMARY

In one aspect, the present disclosure provides a centerless roll grinding machine having a frame that extends laterally and longitudinally to be positioned under a generally cylindrical work roll having a narrower neck on each longitudinal end. A grinding wheel assembly includes a grinding wheel housing received on a first lateral portion of the frame for longitudinal and lateral movement. The grinding wheel assembly includes a grinding wheel presented on a second side of the grinding wheel housing that is opposite to the first side. The frame includes a vertical support extending from a second lateral portion. A lateral support is received by the vertical support of the frame and extending horizontally in the first direction to contact the second side of one neck of the work roll. A lower support is received by and extends generally upwardly from the frame displaced in the first lateral direction from a geometric center of the neck of the work roll to cooperate with the lateral support to provide a V-channel support to hold the work roll for rotation about a longitudinal axis. The lateral support includes a horizontal ram and a lateral support device. The lateral support device includes more than one bearing pad that are radially spaced along a side of the neck in opposition to the grinding wheel. Each pair of bearing pads is pivotally attached to an averaging link that is pivotally coupled to the horizontal ram to reduce horizontal displacements of the work roll caused by a radial variation in the neck.

As used herein, the term "roll" will be understood as including any of a wide variety of work rolls, back-up rolls, feed rolls, pressure rolls, or the like, used in the variety of industrial applications such as steel, aluminum, and paper handling and processing, and similar applications. Generally, such rolls featured relatively large diameters (e.g., 12-80 inches, or 30-200 cm) and can weigh more than 50 tons (45 tonnes), although the apparatus and method of the present invention has utility for measuring and machining rolls of virtually any size. As mentioned above, eccentricity of such rolls will be understood to mean the combination of the out-of-roundness and concentricity errors or total indicator run-out from mean axis of rotation of the roll.

As an example, the rolls might be made of air-hardened tool steel. In one or more embodiments, a slight crown (e.g., about 0.010 inches, or about 0.25 mm) may be preferred on the diameter of each roll to facilitate alignment of the rolls in a machine frame, to guarantee uniform loading and to prevent marking of the roll by heavy contact with an edge of a roll support.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 4A:
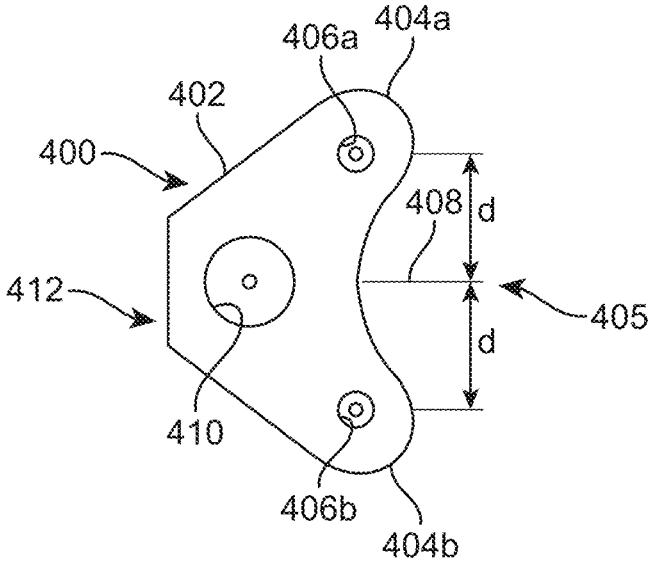
FIG. 4A is a side view of an averaging link, according to one or more embodiments.

According to aspects of the present innovation, FIG. 4A depicts a side view of an averaging link 400 that comprises a plate 402 that is cut from plate steel with symmetric first and second arms 404*a*-404*b* that generally extend away from each other (up and down as depicted) and slightly toward a workpiece side 405 (right as depicted). First and second connection holes 406*a*-406*b* are distally formed respectively in each of the first and second arms 404*a*-404*b* at a same distance from a centerline 408 of the averaging link 400 (horizontal as depicted). A pivot hole 410 is formed in the plate 402 on the centerline 408 proximate to a support side 412 (left as depicted) of the averaging link 400. First and second connection holes 406*a*-406*b* are equidistant from each other and equidistant to pivot hole 410. Pivot hole 410 horizontally translates an amount that is an average (mean) of a horizontal position of the first and second connection holes 406*a*-406*b*.

Figure 4B:
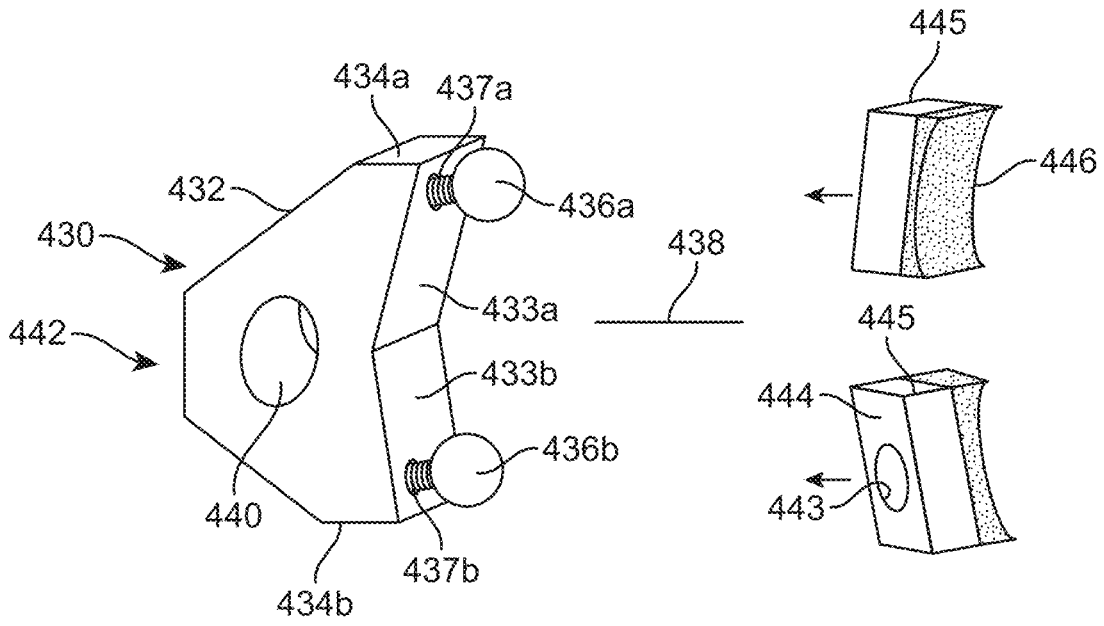
FIG. 4B depicts a three-dimensional isometric view of a spherically mounted averaging link that is variation of the averaging link of FIG. 4, according to one or more embodiments.

FIG. 4B depicts a three-dimensional view of a spherically mounted averaging link 430 that is variation of the averaging link 400 (FIG. 4). A plate 432 has a thickness sufficient for forming mounting fixtures on workpiece side face 433*a*-433*b* respectively of first and second arms 434*a*-434*b*. In particular, the mounting fixtures are first and second pivot ball 436*a*-436*b* mounted on threaded rods 437*a*-437*b* that are bolted to respective workpiece side face 433*a*-433*b* respectively of first and second arms 434*a*-434*b*. Pivot ball 436*a*-436*b* are at a same distance from a centerline 438 of the averaging link 430 (horizontal as depicted). A pivot hole 440 is formed in the plate 432 on the centerline 438 proximate to a support side 442 (left as depicted) of the averaging link 430. First and second pivot ball 436*a*-436*b* are equidistant from each other and equidistant to pivot hole 440. Pivot hole 440 horizontally translates an amount that is an average (mean) of a horizontal position of the first and second pivot ball 436*a*-436*b*. When used as a first-tier averaging link, each of the pivot ball 436*a*-436*b* are received respectively of a spherical pocket 443 formed in a back side 444 of a bearing pad 445 that have a curved babbitt surface 446. The spherical ball joint engagement enables movement that is a combination of tilting and self-aligning to occur. The proximity of an adjacent bearing pad 445 limits or prevents skewing.

Figure 4C:
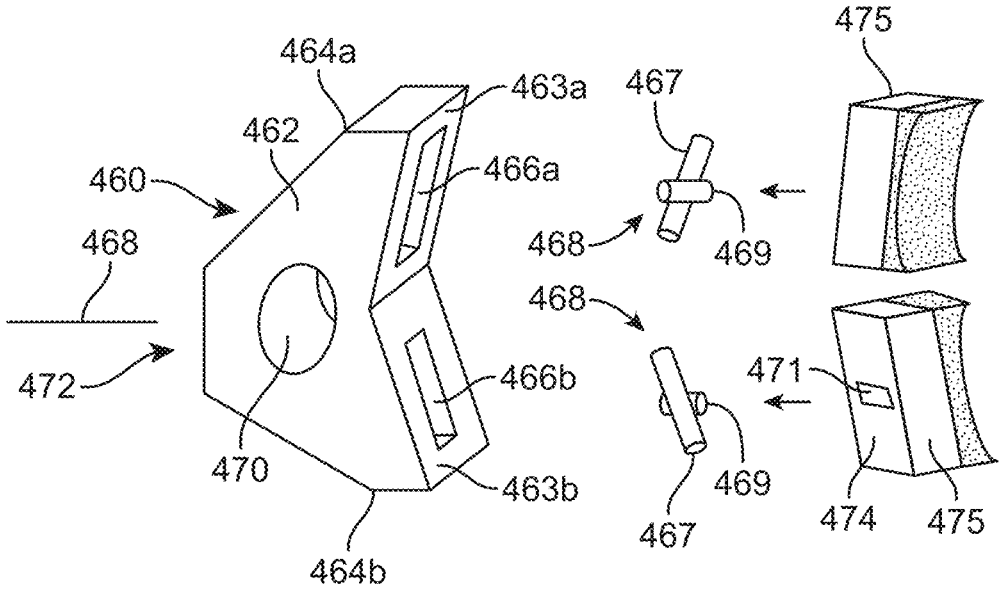
FIG. 4C depicts a three-dimensional isometric view of a cross cylinder mounted averaging link that is variation of the averaging link of FIG. 4, according to one or more embodiments.

FIG. 4C is a three-dimensional view of a cross cylinder mounted averaging link 460 that is variation of the averaging link 400 (FIG. 4). A plate 462 has a thickness sufficient for forming mounting fixtures on workpiece side face 463*a*-463*b* respectively of first and second arms 464*a*-464*b*. In particular, the mounting fixtures are first and second cylindrical pockets 466*a*-466*b* formed in respective workpiece side face 463*a*-463*b* respectively of first and second arms 464*a*-464*b*. First and second cylindrical pockets 466*a*-466*b* are at a same distance from a centerline 468 of the averaging link 460 (horizontal as depicted). A pivot hole 470 is formed in the plate 462 on the centerline 468 proximate to a support side 472 (left as depicted) of the averaging link 460. First and second cylindrical pockets 466*a*-466*b* are equidistant from each other and equidistant to pivot hole 470. Pivot hole 470 horizontally translates an amount that is an average (mean) of a horizontal position of the first and second cylindrical pockets 466*a*-466*b*. When used as a first-tier averaging link, a vertical cylinder 467 of respective cross cylinder components 468*a*-468*b* is received in first and second cylindrical pockets 466*a*-466*b*. A horizontal cylinder 469 of respective cross cylinder components 468*a*-468*b* is received respectively in a horizontal cylindrical pocket 471 formed in a back side 474 of a bearing pad 475. The horizontal cylindrical pocket 471 receives the horizontal cylinder 469 for rotation movement. The vertical cylinder 467 is received in the respective slot 466*a*-466*b* for tilting movement.

Figure 5:
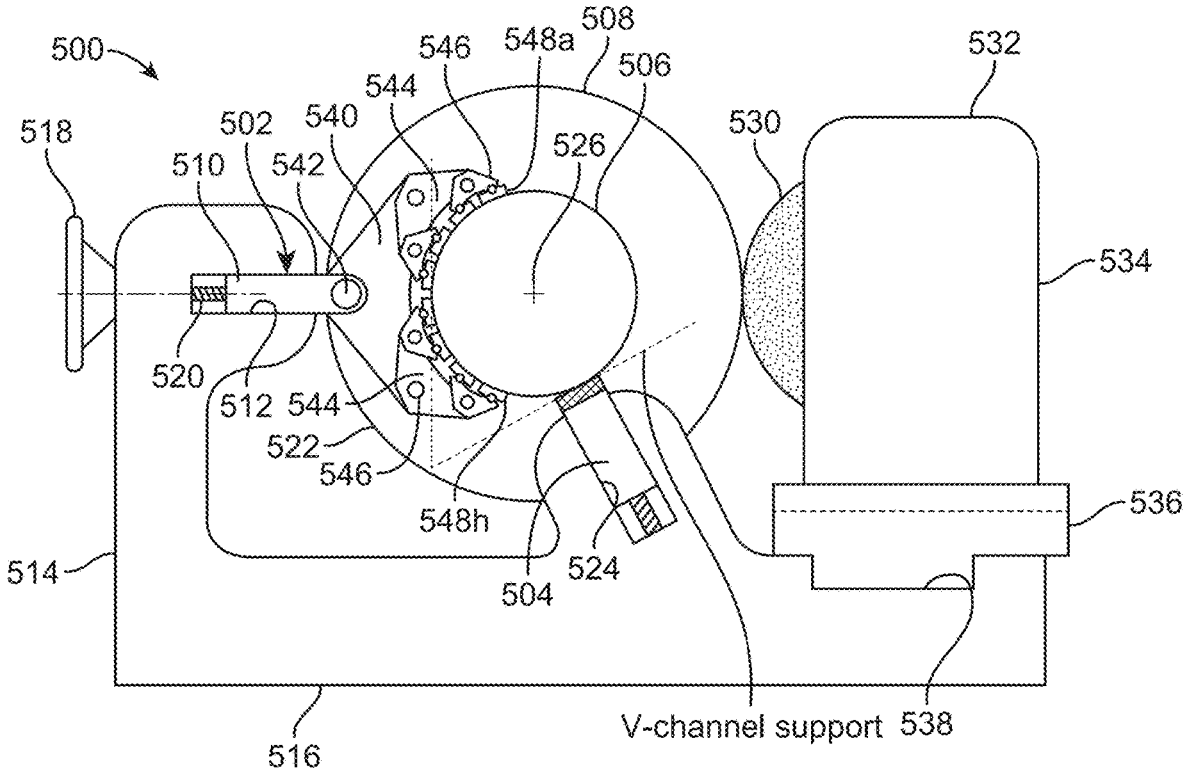
FIG. 5 is a front view of a grinding machine having an example lateral support that utilizes averaging links, according to one or more embodiments.

According to one or more aspects of the present innovation, FIG. 5 is an end view of a grinding machine 500 having an example lateral support 502 and a lower ram 504 of a variability reducing V-block that contacts a cylindrical neck 506 of a work roll 508. The example lateral support 502 includes a solid, non-rotating horizontal slide member (ram) 510 slidingly received in an inwardly directed, horizontal channel 512 formed in a vertical support portion 514 of a support frame 516 of the grinding machine 500. An actuator wheel 518 turns an adjustment screw 520 that passes through a backside of the vertical support portion 514 into horizontal channel 512. Adjustment screw 52 limits how deeply the horizontal slide member (ram) 510 is positioned in the horizontal channel 512 to distally position an attached 4-stage support device 522 according to aspects of the present innovation. The lower ram 504 is received in a lower channel 524 that is directed toward an axial centerline 526 of a work roll 508 and slightly backward canted so that the center of gravity (axial centerline 526) of the work roll 508 is horizontally positioned between the example lateral support 502 and the lower ram 504. The lower ram 504 is adjusted to position the axial centerline 536 of work roll 508 in vertical alignment with the horizontal channel 512. A grinding wheel 530 is horizontally aligned with the axial centerline 526 by a grinding wheel housing 532 that is received for longitudinally translation to the support frame 516. The grinding wheel housing 532 has an upper portion 534 that is adjustably translatable to a lower portion 536 that is held in a channel 538 of the support frame 516.

Figure 1:
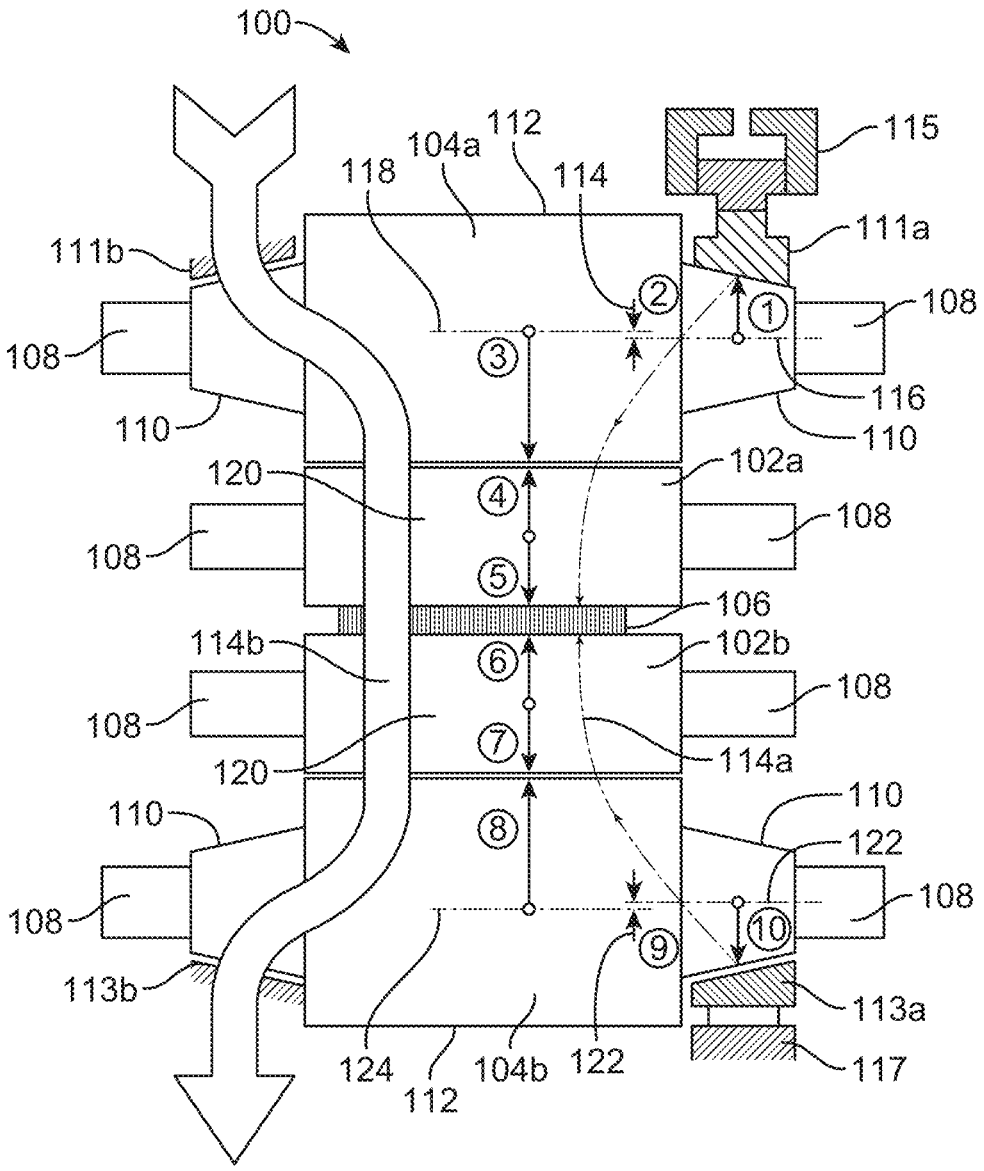
FIG. 1 (Prior Art)
FIG. 1 is a front view of a generally known four-high steel rolling machine.
Figure 2:
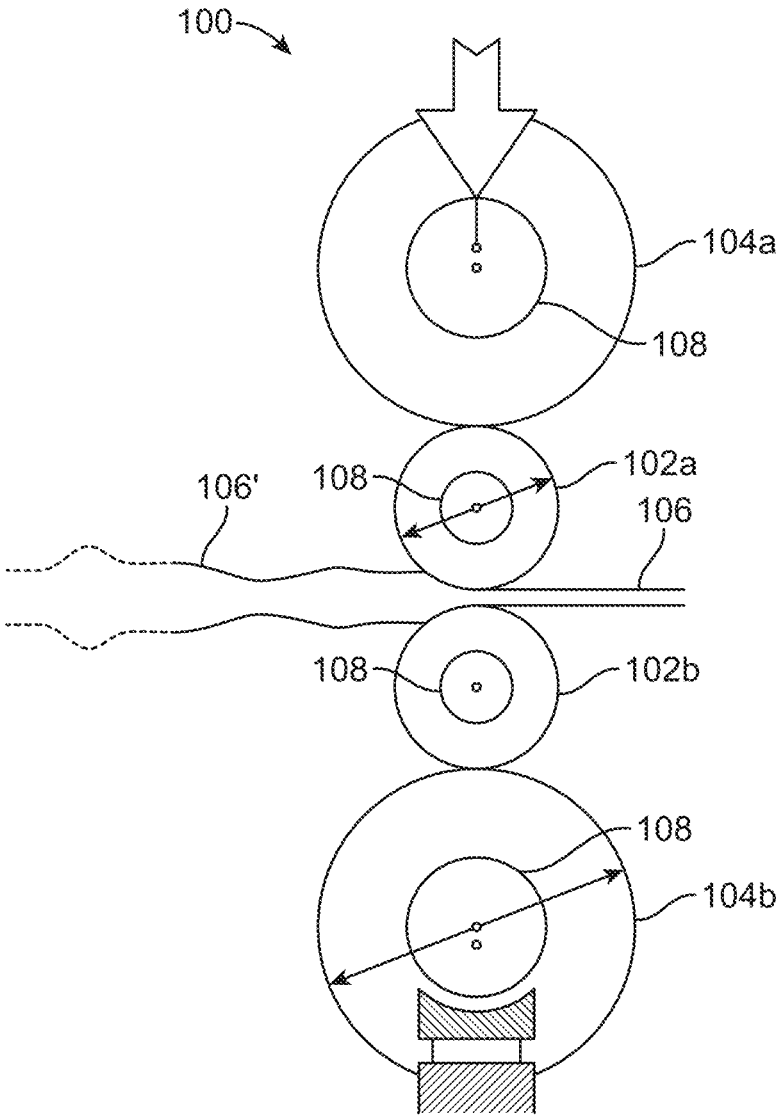
FIG. 2 (Prior Art)
FIG. 2 is a side view of the generally known four-high steel rolling machine depicted in FIG. 1.
Figure 3:
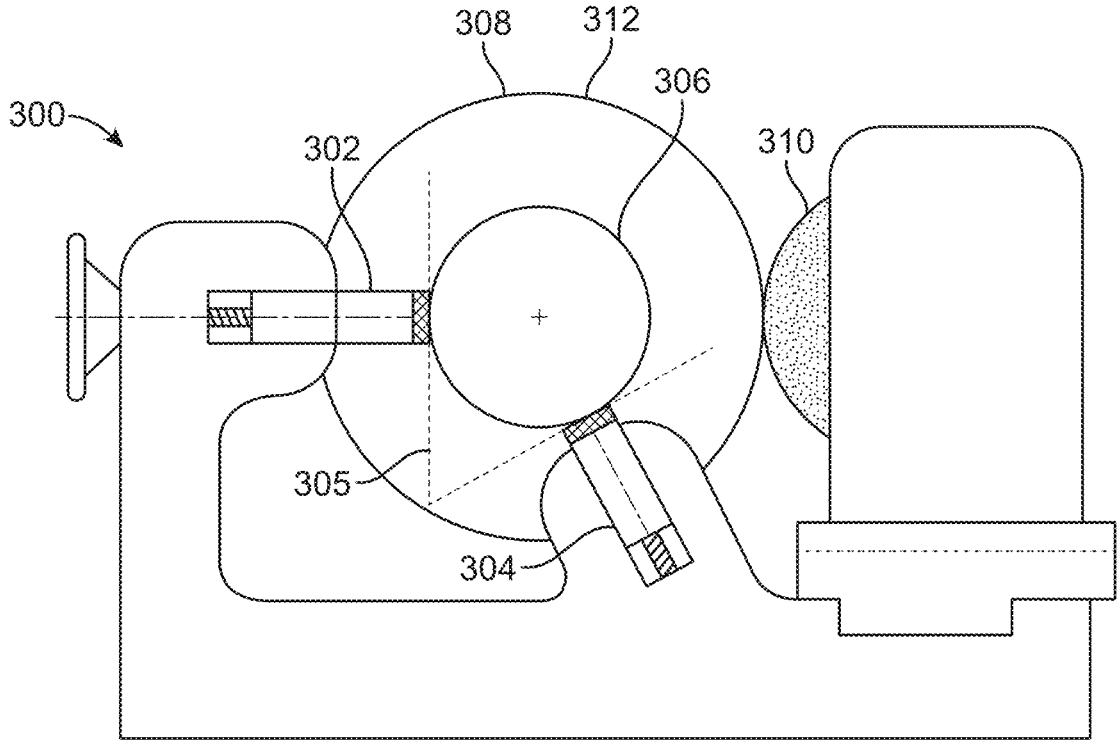
FIG. 3 (Prior Art)
FIG. 3 is an end view of a generally known centerless roll grinding machine.
Figure 6:
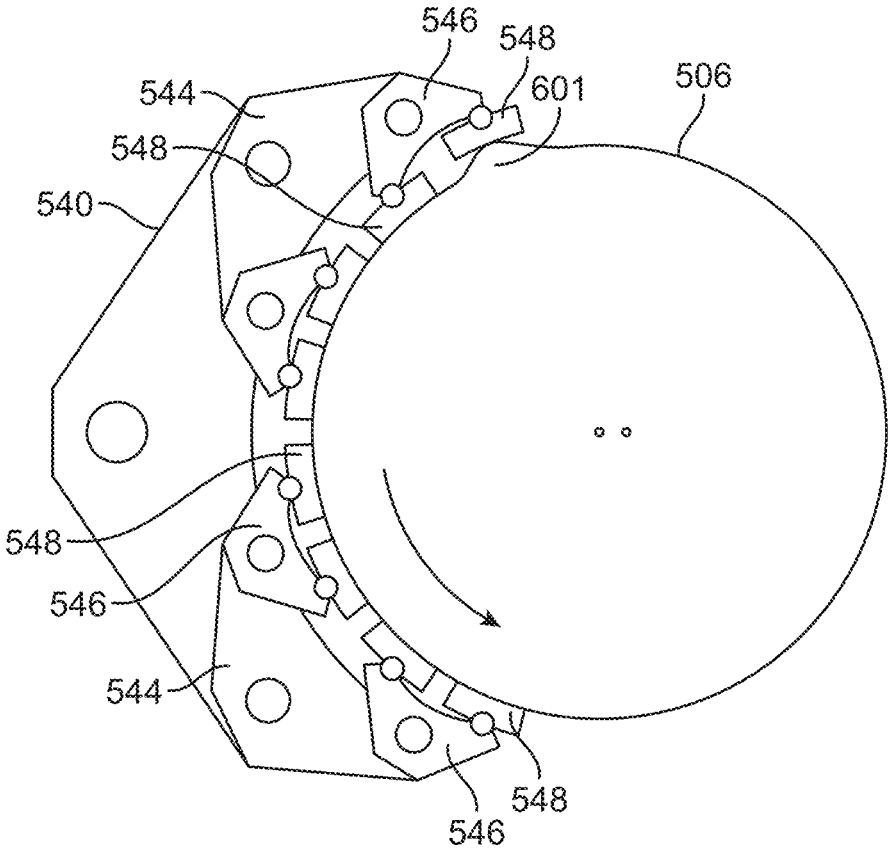
FIG. 6 is a front detail view of a lateral support device of the grinding machine of FIG. 5, according to one or more embodiments.

The horizontal lateral support 502 includes an inner third tier averaging link 540 of the 4-stage support device 522 that is mounted to horizontal slide member (ram) 510 by proximal pin 542. FIG. 6 is a detail side view of the four-stage support device 522 and roll neck 506. A pair of second tier averaging links 544*a* are pivotally attached to the third-tier averaging link 540. A pair of first tier averaging links 546 are respectively pivotally attached to each second-tier averaging link 544*a*. A pair of bearing pads 548 are respectively pivotally coupled to each first-tier averaging link 546*a*. In one or more embodiments, the example lateral support 502 has three averaging stages to reduce copying of a dimensional error (bump 601) in the neck 506 by a factor of 8. The height of the bump 601 contacts only one of the eight (8) bear pads 548 at a time. Copying of the bump 601 results in a horizontal translation of center or rotation of the neck 506 that is $1/8^{th}$ of the height of bump 601. It should be appreciated that three averaging stages is illustrative. Fewer or additional averaging stages can be implemented to achieve a desired amount of reduction. The averaging principle of this kinematic system is cited in "Theory of Machines", Joseph Edward Shigly, McGraw-Hill Book Co., 1961, page 335, Section 13-2 and FIG. 13-1*a*, the disclosure of which is hereby incorporated by reference in its entirety.

Figure 7:
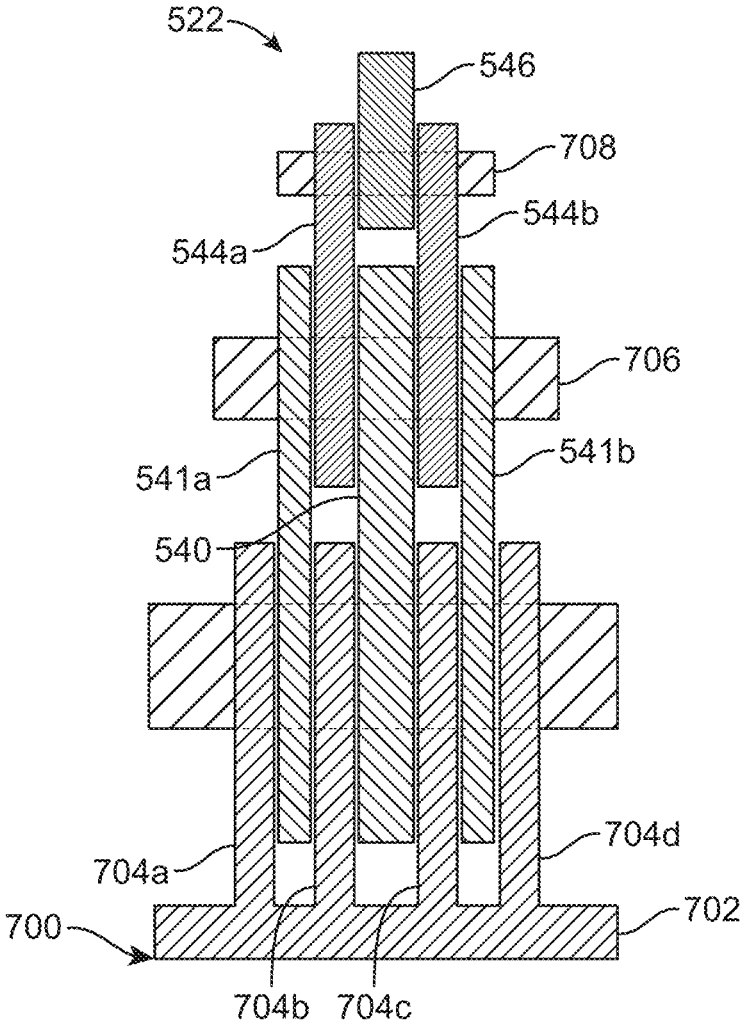
FIG. 7 depicts a top assembled view of an example four-stage support device, according to one or more embodiments.
Figure 8:
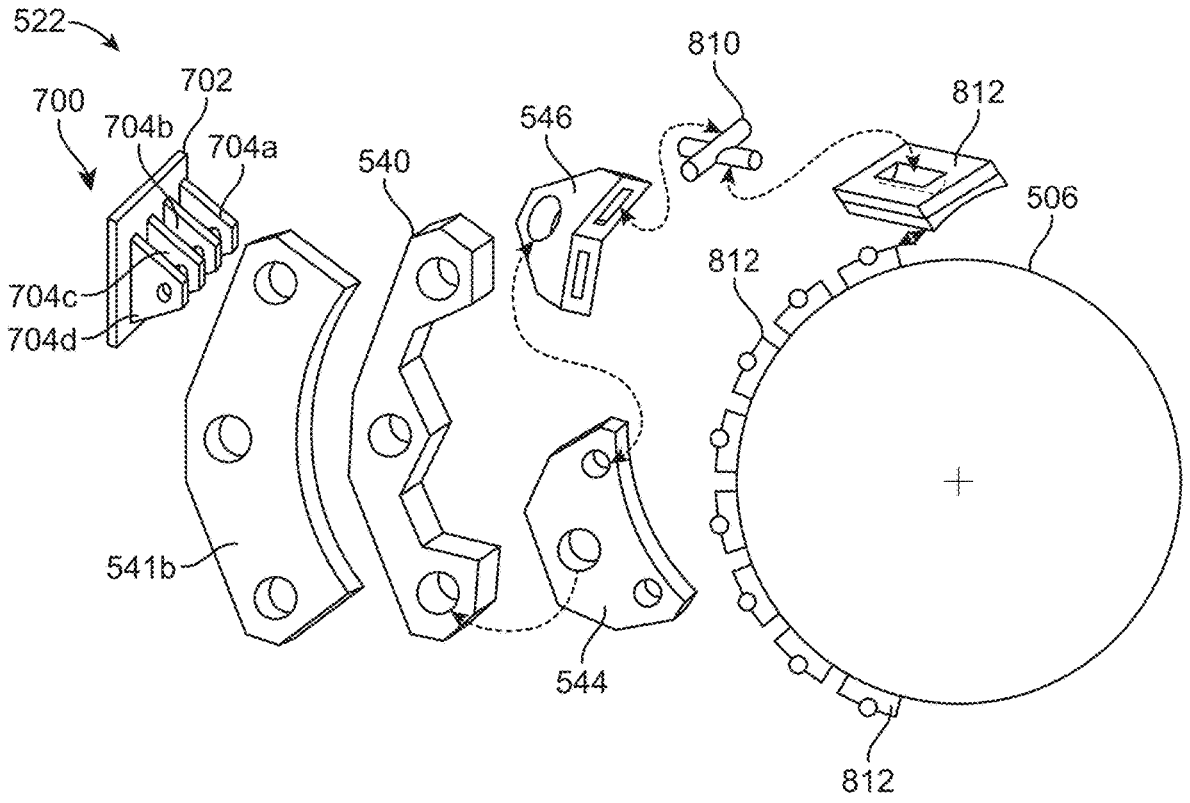
FIG. 8 depicts a three-dimensional, exploded view of the four-stage support device of FIG. 7, according to one or more embodiments.

In one or more embodiments, FIG. 7 depicts a top assembled view and FIG. 8 depicts a three-dimensional, exploded view of the four-stage support device 522 that includes duplications of components for additional strength and longitudinal support. With particular reference to FIG. 7, a base housing 700 include a transverse plate 702 with four distally projecting and parallel first pin tabs 704*a*-704*d* that receive proximal pin 542. The inner third tier averaging link 540 is received between pin tabs 704*b*-704*c*. A first outer third tier averaging link 541*a* is received between pin tabs 704*a*-704*b*. A second outer third tier averaging link 541*b* is received between pin tabs 704*c*-704*d*. Each of the two second tier averaging links 544*a* are bolstered by a respective parallel positioned second tier averaging link 544*b*. Each of two midpoint pins 706 passes through a stack of first outer third tier averaging links 541*a*, second tier averaging link 544*a*, inner third tier averaging link 540, second tier averaging link 544*b*, and outer third tier averaging link 541*b*. Each of four distal pins 708 passes through a respective parallel pair of second tier averaging links 544*a*-544*b* and one of the four (4) first tier averaging links 546. With particular reference to FIG. 8, each of the four first tier averaging links 546 are pivotally coupled via crossed cylinder components 810 to bearing pads 812.

Figure 9:
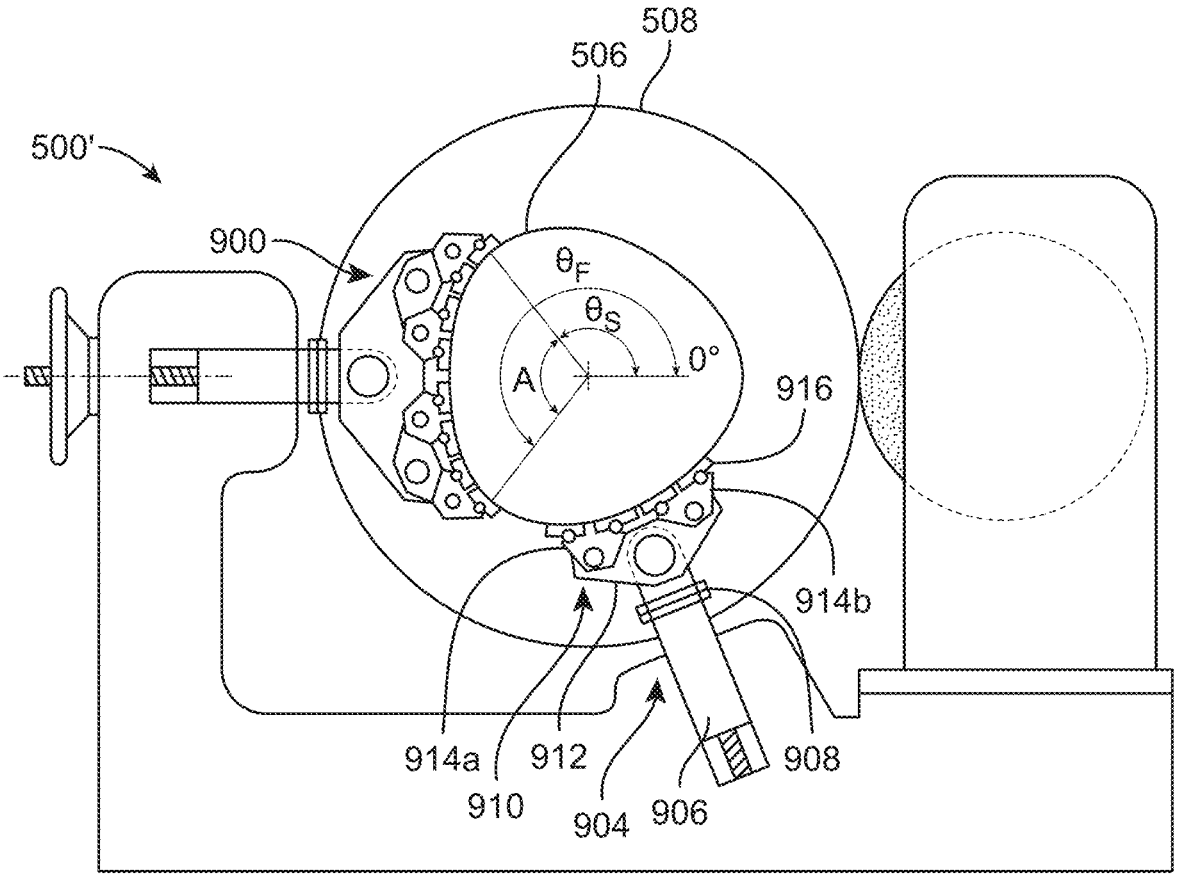
FIG. 9 is a front detail view of a lateral support device of the grinding machine of FIG. 5 that further includes a lower support device having averaging links, according to one or more embodiments.

FIG. 9 is an end view of the grinding machine 500' having the example lateral support 502 as described above with regard to grinding machine 500 of FIG. 5. In addition, grinding machine 500' has a lower support 904 according to aspects of the present innovation that further reduces variability of V-block that contacts the cylindrical neck 506 of the work roll 508. A lower ram 906 of the lower support 904 is attached to a base housing 908 of a two-stage support device 910. A second-tier averaging assembly 912 of the two-stage support device 910 averages generally vertical displacements of a pair of first tier averaging links 914*a*-914*b*, each of which average generally vertical displacements from a respective pair of bearing pads 916. In one or more embodiments, the angle $\Theta_S$ is about 110° from the direction to the right as depicted (0°) counterclockwise to the vector from the geometric center (GC) to an upper most bearing pad 548*a* of the lateral support 502. The angle $\Theta_F$ is about 250° from the direction to the right as depicted) (0°) to the vector from the geometric center (GC) to a lower most bearing pad 548*h* of the lateral support 502. The eight (8) bearing pads 548*a*-548*h* are 20° apart for a total angle "A" of 140°. This embodiment provides, in a centerless roll grinding machines, a mechanical linkage system supports out-of-round necks of large rolls.

Averaging links translate a small fraction (e.g., about ⅛th) of the radial variation of the neck regardless of the shape or extent of the out-of-round errors of the neck. The averaging link system responds to varying radii of a non-round neck in a manner that will reduce (approximately an 8 times reduction) the horizontal motion of the neck's geometric center, regardless of the shape (the number of lobes) or extent of the radial variation that is encountered. The averaging link system acts as a passive mechanical analog computer that computes a moving average of 8 neck radii. This rounding action is fully automatic, requiring no monitoring or control action by a machine operator.

In one or more embodiments, the grinding apparatus may include one or more drive means (not shown) for rotating a roll or other workpiece about its longitudinal axis. In one or more embodiments, the drive means is provided in the form of one or more drive wheels for frictionally contacting the roll or other workpiece to impose rotational energy. In one or more embodiments, the drive means further comprises means for providing rotational energy (e.g., a drive motor), with a drive belt or chain transmitting such rotational energy to the drive wheels. In one or more embodiments, the outer surface of drive wheel include a friction surface such as soft polymer or the like to enhance the frictional interaction with a roll and to make the transfer of rotational energy more efficient.

The invention also involves a rotating grinding- or cutting tool, in particular a grinding wheel or grinding roller that has a body as in the present invention and at least one layer of abrasive material on one peripheral surface and/or at least one lateral surface of the body, this material can be cubic boron nitride (CBN) or diamond.

In one or more embodiments, the grinding apparatus may include using grinding oil or grinding emulsion as cooling lubricant. The apparatus for machining a cylindrical roll or workpiece of the present disclosure can be applied to a machining apparatus for performing finish machining, such as grinding, of an outer circumferential surface of a cylindrical workpiece on the basis of an inner circumferential surface after heat treatment of the workpiece.

In the detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized, and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A centerless roll grinding machine comprising:

a frame that extends laterally and longitudinally to be positioned under a generally cylindrical work roll having a neck on each longitudinal end;

a grinding wheel assembly comprising a grinding wheel housing received on a first lateral portion of the frame for longitudinal and lateral movement and comprising a grinding wheel presented on a second side of the grinding wheel housing that is opposite to a first side, the frame comprising a vertical support extending from a second lateral portion;

a lateral support received by the vertical support of the frame and extending horizontally in a first direction to contact a second side of the neck of the work roll;

a lower support received by and extending upwardly at an angle from the frame displaced in a first lateral direction from a geometric center of the neck of the work roll to cooperate with the lateral support to provide a V-channel support to hold the work roll for rotation about a longitudinal axis; and the lateral support comprising a horizontal ram and a lateral support device, the lateral support device comprising at least two pairs of bearing pads that are radially spaced along a side of the neck in opposition to the grinding wheel, each pair of the bearing pads pivotally attached to a respective first tier averaging link that is pivotally coupled to the horizontal ram, at least one pair of second tier averaging links that are interposed between each of the respective first tier averaging links and the horizontal ram, each pair of said first tier averaging links being pivotally attached to a respective said second tier averaging link, and at least one third tier averaging link that is interposed between each of the respective second tier averaging links and the horizontal ram, each pair of said second tier averaging links being pivotally attached to the respective said third tier averaging link, to reduce horizontal displacements of the work roll caused by a geometric error in the neck, and to utilize averaging ability of the bearing pads enabling the work roll to move in a definitive space, wherein the lateral support device comprises eight bearing pads, wherein each of the respective first tier averaging links each comprise two vertical cylindrical pockets and each of the bearing pads comprise a horizontal cylindrical pocket, the lateral support device further comprises for each bearing pad a cross cylinder element having a vertical cylinder and horizontal cylinder fastened together, the vertical cross cylinder being inserted into the respective vertical cylindrical pocket of the respective first tier averaging link and the horizontal cross cylinder being inserted into the horizontal cylindrical pocket of the respective bearing pad, wherein each of the pivotally attached bearing pads are configured to contact the geometric error in the neck one bearing pad at a time.

2. The centerless roll grinding machine of claim 1, wherein the lower support comprises a lower ram and a lower support device, the lower support device comprising at least one pair of bearing pads that are radially spaced along an underside of the neck in opposition to the weight of the work roll due to gravity, each pair of the bearing pads of the lower support device pivotally attached to an other first tier averaging link of the lower support device and is pivotally coupled to the lower ram to reduce vertical displacements of the work roll caused by the geometric error in the neck.

3. The centerless roll grinding machine of claim 2, wherein the lower support device further comprises at least two of the other first tier averaging links, and at least one other second tier averaging link that is interposed between the at least two other first tier averaging links of the lower support device and the lower ram, each pair of the other first tier averaging links of the lower support device being pivotally attached to a respective said other second tier averaging link of the lower support device to further reduce vertical displacements of the work roll caused by the geometric error in the neck.

* * * * *